United States Patent [19]

Dohet

[11] 4,091,485

[45] May 30, 1978

[54] COLLAPSIBLE STRUCTURE

[76] Inventor: Pierre E. Dohet, 109 South Lee St., Alexandria, Va. 22314

[21] Appl. No.: 734,999

[22] Filed: Oct. 22, 1976

[51] Int. Cl.[2] ..... B63B 7/06

[52] U.S. Cl. ..... 9/2 C; 52/222; 296/23 C

[58] Field of Search ..... 9/2 C, 2 F, 2 R; 52/63, 52/222; 135/1 R, 15 CF, 15 PQ; 296/23 C, 23 A, 26

[56] References Cited

U.S. PATENT DOCUMENTS

| | | | |
|---|---|---|---|
| 1,330,363 | 2/1920 | Whitt | 135/15 PQ |
| 1,822,810 | 9/1931 | Hart | 9/2 C |
| 3,416,170 | 12/1968 | Dohet | 9/7 X |
| 3,619,001 | 11/1971 | Borskey | 296/26 X |
| 3,780,477 | 12/1973 | Sprung | 52/222 X |
| 3,811,454 | 5/1974 | Huddle | 52/63 X |
| 3,971,395 | 7/1976 | Lipinski | 135/1 R |

*Primary Examiner*—Robert B. Reeves
*Assistant Examiner*—Edward M. Wacyra
*Attorney, Agent, or Firm*—Burton, Parker & Schramm

[57] ABSTRACT

A collapsible watertight structure has a pair of essentially rigid opposite end members linked together by a flexible skin or sheet so that the structure may be repeatedly extended and collapsed. Longitudinal beams which are laterally rigid but longitudinally compressible extend between and are secured at their ends to the end members and hold the structure in distended position. Each beam is secured to one of the end members by a universal joint, such as a ball and socket, and is secured to the other end member by a joint which is slidable transversely thereof whereby the end members are placed under chordal distension urging them apart and causing the flexible skin to be distended and stressed between the end members to attain its shape. Flexible cable members embedded or otherwise secured to the flexible sheet and secured to the end members limit the distension and stress imposed by the end members on the flexible sheet. Floatation devices are mounted on each of the longitudinal beams when the device is used as a collapsible dinghy. A latch is provided to hold each of the beams in erected positions.

20 Claims, 8 Drawing Figures

COLLAPSIBLE STRUCTURE

FIELD OF INVENTION

The present invention relates generally to structures which may be rapidly erected and collapsed. The principles disclosed can be employed in formation of a collapsible dinghy, pontoon, row boat, shipping containers and in shelters.

BACKGROUND OF THE INVENTION

While collapsible structures are not in themselves new, they have been attended by various difficulties, such as multiplicity of parts, which render such devices difficult to erect and difficult to maintain in an erected position with the consequent danger of loss of parts when the device is collapsed. Examples of prior art collapsible structures are shown in U.S. Pat. Nos. 2,405,627; 2,790,978; 1,937,729; 2,346,081; 2,636,196; 3,028,612; and 3,416,170.

The instant invention overcomes this difficulty since the structure disclosed comprises only three main elements; i.e., a flexible skin member having end pieces secured thereto, and two compressible members. Upon removal of the compressible members, the end members and skin can be rolled into a compact bundle. The compressible members have been made separable so that they may be stored in the same bundle. A dinghy employing the herein disclosed principles has been erected and dismantled in less than one minute.

Briefly in accordance with this invention, controlled longitudinal extension is provided in any structure of foldable characteristics by means of a chord compression system or mechanism. In essence, a suitable structure is provided with a pair of rigid or semi-rigid end sections and longitudinal members capable of providing pressure between the two rigid or semi-rigid end members which will hold the structure in erected position. Wires or cables are provided in the flexible intermediate portion of the structure to limit the amount of stress imposed upon the flexible fabric by these compressible members. By removing the longitudinal stressing members the structure can be folded transverse to the longitudinal axis. The means for providing chord compression in each of the longitudinal members is achieved by means of hollow compression tubes which may be either round or square or any suitable shape. At one end of said tubes there is a socket which will fit upon a ball secured to one of the end members. At the opposite end of the tubes is a cut-out or bifurcated device which is adapted to slide along a bar secured to the other end member. The entire longitudinal member or tube, when the male member is in the female member, is longer in physical dimensions than that of the longitudinal dimension of the erected structure such that the bifurcation in the outer end of the tube may be placed diagonally off center and then slid outboard forcing the end members apart and thereby holding them and the skin distended.

In the particular embodiment disclosed herein, a dinghy is shown. In such embodiment a cable is molded or otherwise secured to the gunwale portion of the flexible skin and to each end member and this cable is specifically dimensioned such that when the longitudinal member is in place it prevents overloading of the skin at that particular side of the dinghy in tension; the cable restricting the amount of load taken by the skin. The end members of the device are generally flat as compared to the box construction of my prior U.S. Pat. No. 3,416,170, and constructed either hollow or completely solid. The fore and aft positions of the end members relative to the longitudinal axis of the structure is controlled solely by the accurate pre-cut shape of the flexible fabric affixed to the end pieces. No mechanical relative positioning system such as knife-action and so forth is used. Absolute control of this relationship can be obtained by exacting control of the length of the two flexible cables or wires. The positioning of the longitudinal members where they connect to the end pieces is somewhat critical to maintain the assembled dinghy in its desired position and is preferably slightly below the horizontal centerline of each end member. From the above it can be seen that it is possible to generate or erect a structure, such as a boat, a shelter or a collapsible container with two or more essentially flat planes at their extremities with a minimum of two compression beams. In the case of a boat or dinghy, floatation modules may be mounted upon the longitudinal compression members to provide the required U.S. Coast Guard floatation. These floatation modules may also act as longitudinal ribs maintaining the shape of the fabric when it is subjected to lateral loading and outside pressure.

Dynamic fatigue has been eliminated at the structural joint between the flexible fabric and the end members. The coated fabric of the flexible portion of the structure has been cemented or molded to an intermediate elastomeric extrusion having a laterally extending male member which fits into a complementary shaped female groove disposed within the side and bottom edges of the end members. To maintain the above in assembled position, a tensioned cable extends through an aperture in the male member. By this arrangement all bolts and rivets and so forth have been eliminated from the mounting of the flexible skin to the two end members. The elastomeric extrusion fits tightly in the groove in the end members and the groove is coated with adhesive sealant or bedding compound. The elastomeric extrusion is then pressed into the groove. The internal cable is then tightened along the entire periphery of the end member thus effectively retaining the elastomeric extrusion in the groove with a minimum of reliance upon a bonded joint. This method enables the connection of highly incompatible materials (from an adhesive standpoint) such as plastics of the olefin group and elastomeric materials, particularly with the structural foam plastics showing poor mechanical fastener retention and having low compression value. In none of the modifications do any sharp angles or corners appear between the skin member and the end members. I therefore provide a natural and progressive change of direction of the fabric which by its nature is opposed to the deformation expected from practical load forces and avoids the sharp break that would normally result from a hard angle type of construction. In the case of a dinghy each of the two longitudinal members exert a force of approximately 150 pounds per square inch against the end members. Due to the pivotal action of one end of the structural member and the slide action of the opposite end, a larger mechanical advantage is achieved whereby the actual force to cause erection or collapse of the device by sliding the structural longitudinal member along the bar is extremely small.

The structures employing the principles of the present invention can be used for humam occupation or for the storage and shipment of goods. They can be readily erected and collapsed and can be folded into a small and compact state for ease and convenience or transport and for storage when not in use.

While the present invention is particularly useful and suitable for such purposes as collapsible shelters, containers or vessels for example, the description and illustration of a preferred embodiment of the invention will be directed toward a collapsible boat, particularly of the dinghy type. It is to be emphasized that no restrictions or limitations are intended or are to be placed on the scope or applications of the invention thereby. Rather any limitations or restrictions on the present invention are determined solely from the definition of the invention as recited in the appended claims.

DESCRIPTION OF PREFERRED EMBODIMENT

Figure 1:
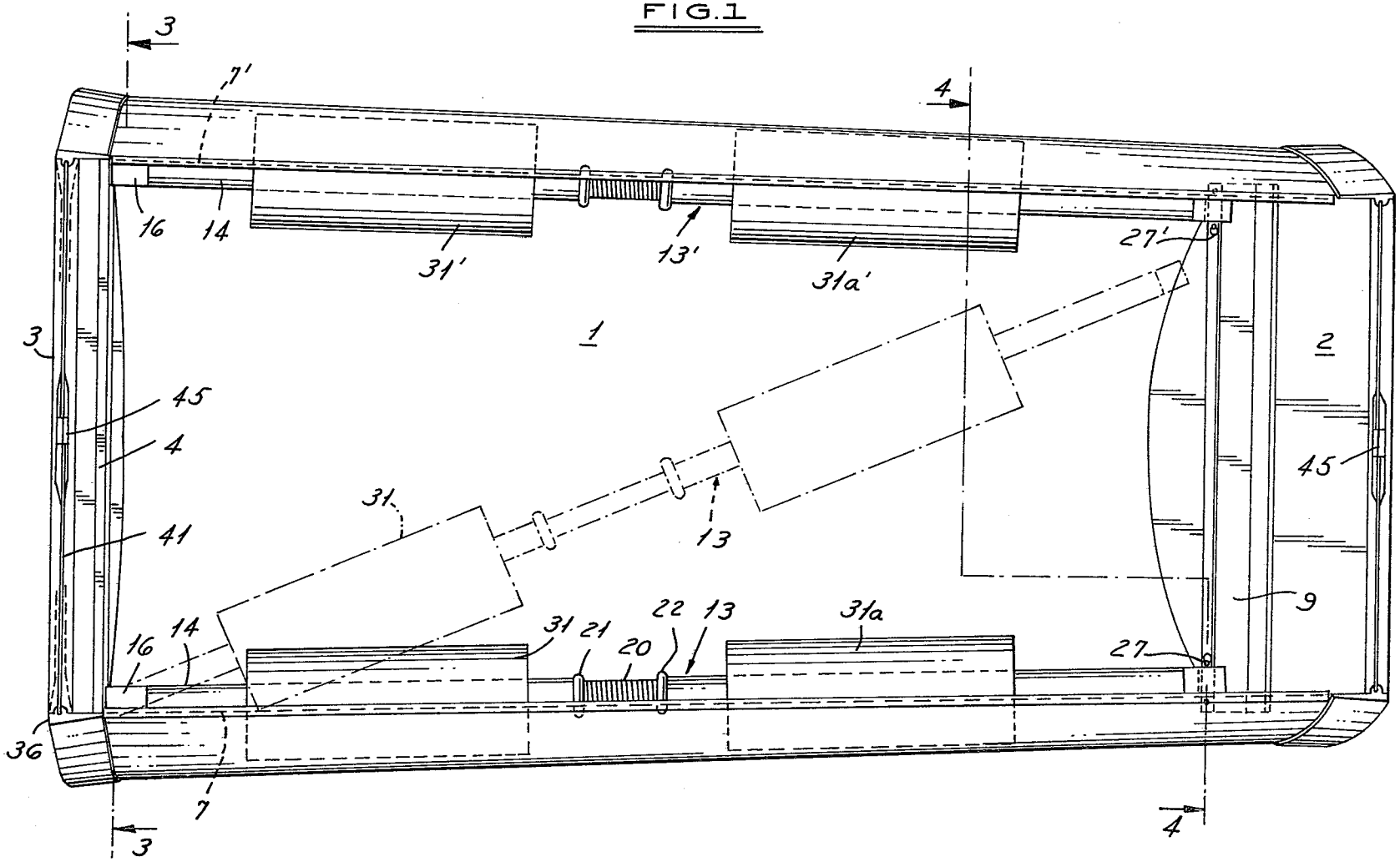
FIG. 1 is a plan view of the preferred modification.
Figure 7:
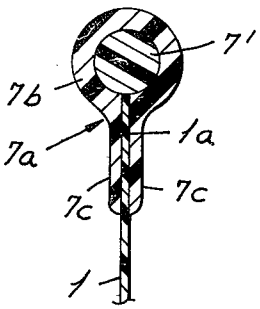
FIG. 7 is a section taken on the Line 7—7 of FIG. 2.

In the preferred embodiment of this disclosure, 1 denotes a flexible skin member which is secured by means later to be disclosed to each of the bow member 2 and the stern member 3. The stern member has mounted thereto below the horizontal mid-portion thereof a reinforcing channel member 4 having formed thereon at opposite ends ball members 5 adjacent the outer periphery thereof of the stern member. An angle bracket 6 extends across the upper edge of the stern member 3 and is secured thereto and adapted to receive at opposite ends one end of a pair of limiting cables 7 and 7' which are molded or otherwise secured to each peripheral edge of the skin member at the gunwale. A preferred mode of securing the cables to the gunwale is shown in FIG. 7 wherein an elastomeric extrusion *7a*, having an enlarged cable receiving portion *7b* with opposed flanges *7c* bonded or otherwise secured in embracing relation over the upper marginal edge *1a* of the skin, retains the cables to the skin while allowing relative movement therebetween. A bracket 8 similar to bracket 6 is mounted on the upper edge of the bow member 2 and is adapted to receive the opposite ends of cable 7 and 7'. In FIG. 1 brackets 6 and 8 have been omitted for clarity in illustrating other portions of the assembly.

The bow member 2 has disposed below the horizontal centerline thereof a transversely extending track means comprising an angle bracket 9 which extends outwardly from member 2 and terminates in an enlargement 10. Enlargement 10 is substantially cylindrical in cross section and has formed in each of the outer ends thereof an opening for removably receiving a pin 27. A stop 10' is also disposed outwardly of pin 27 at each end of members 9. A towing eye 12 is secured to the outer face of the bow member 2. The bracket 9 performs the dual function of reinforcing the bow member 2 and further is adapted to slidably receive one end of distension means 13 and 13'.

The distension means or distensible members comprise a pair of telescoping beams each of which is spring biased longitudinally outwardly or in extension, and are of such a length that when disposed longitudinally between the bow and stern members 2 and 3 will resiliently urge such members apart thereby distending the structure and stretching or stressing the skin between the bow and stern. These beams are essentially laterally rigid in the sense that unlike the prior art they are not foldable in an operational mode to stress the skin and distend the structure.

The distension means or distensible members 13 and 13' are identical in construction such that a description of one will suffice for both. They are provided for stressing the skin member 1 and for distending the structure and retaining it in erected position, and are disposed substantially at the point where inward collapsing forces are balanced. Distension member 13' includes a hollow rear portion 14 and a hollow forward portion 15. The end portion 14 terminates in a semi-spherical socket member 16 permanently mounted in the end of portion 14. Socket member 16 is adapted to mate with the ball member 5 on the transom bracket 4. End portion 14 slidably receives in its end opposite the socket 16 a sleeve 17 adapted to receive therein a shaft 18 having means 19 at its inner terminal end to prevent removal of sleeve 17 from shaft 18. Shaft 18 and sleeve 17 extend beyond the member 14, and shaft 18 has a coiled compression spring 20 disposed therearound intermediate its ends. The coil spring 20 abuts a shoulder 21 formed on the sleeve 17 and at its opposite end abuts against a shoulder 22 formed on a second sleeve member 23, which is identical to sleeve member 17. A retaining means 24 such as a rivet or bolts, is disposed in aligned openings in the member 15, sleeve 23 and shaft 18 to permanently retain sleeve 23, shaft 18 and forward member 15 in assembled relation. Forward member 15 has permanently secured therein a plug member having a bifurcated portion 26 which is adapted to snugly embrace the enlargement 10 formed on member 6. The pins 27 and 27' are disposed through suitable apertures in the enlargement 10 to retain the members 13 and 13' in their longitudinally erected positions. Stops 10' are disposed in each extremity of enlargement 10 to prevent over-travel of distension member 13 during assembly.

Figure 2:
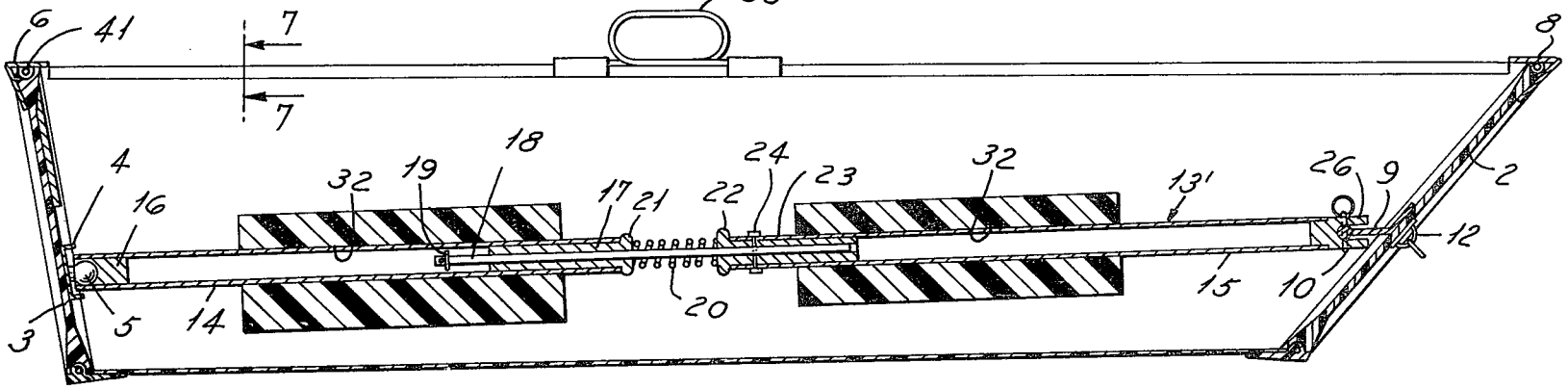
FIG. 2 is a cross section taken on the Line 2—2 of FIG. 1.
Figure 4:
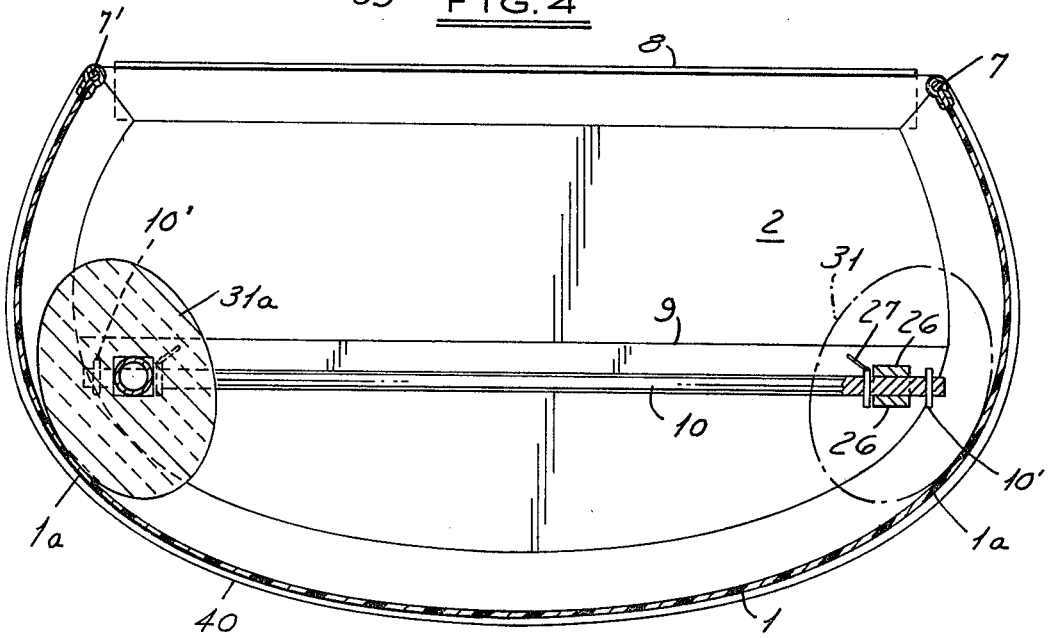
FIG. 4 is an elevation view of the bow looking from the inside of the boat toward the front.
Figure 6:
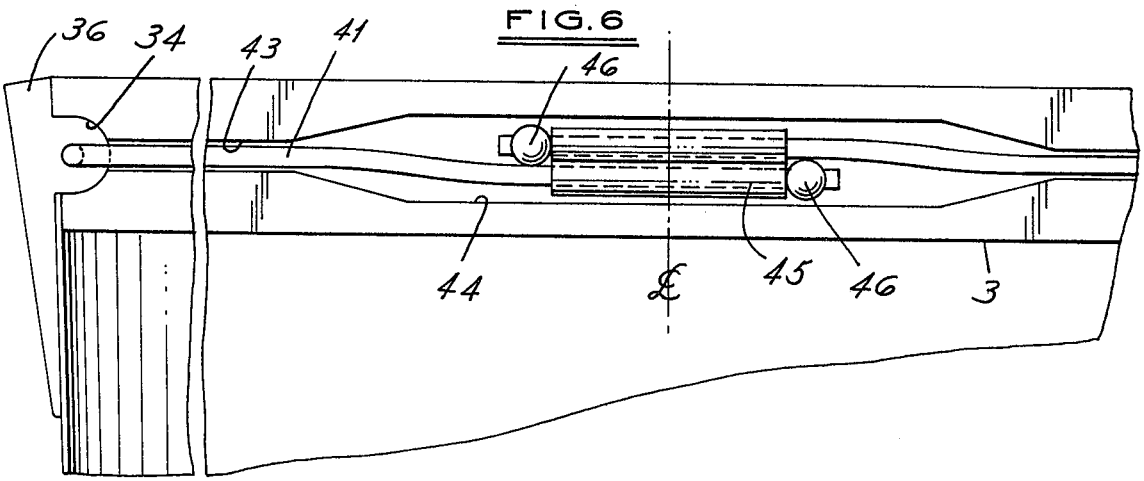
FIG. 6 is a fragmentary plan view of the stern.

In FIG. 1 the dotted line position of the longitudinally extending member 13 illustrates the same longitudinally expanded or extended rendering the member 13 approximately 3 to 5 percent longer than when it is in its compressed position, as shown in FIG. 2. To assemble the member 13 in erected position, its rear end 16 is first mounted on the respective ball member 5 and is held in the dotted diagonal line position as shown in FIG. 1 with the bifurcated portion 26 disposed on the enlargement 10. Member 13 is thereafter forceably slid along the member 10 until it abuts the limit pin 10' (the right hand side of FIG. 4), at which time the pin 27 may be inserted to retain the longitudinal distension member 13 in assembled and stressed position shown in solid outline in FIG. 1. A similar mounting is made by means of the longitudinal member 13' on the other side of the structure. The length of the cable members 7 and 7' is such that they limit the amount of stress which can be applied by the members 13 and 13' on the free edges of the flexible skin 1.

The stern section 3 is enlarged at 29' to receive an outboard engine. Oarlocks 39 (one being shown in FIG. 2) are welded, swaged, cemented or otherwise secured to the cable members 7 and 7'.

Floatation devices 31 and 31*a* are shaped to conform to the desired curvature of the chine portion 1*a* of the boat and have apertures 32 therein adapted to snugly embrace sections 14 and 15 of each of the longitudinally distension members 13 and 13'.

Figure 5:
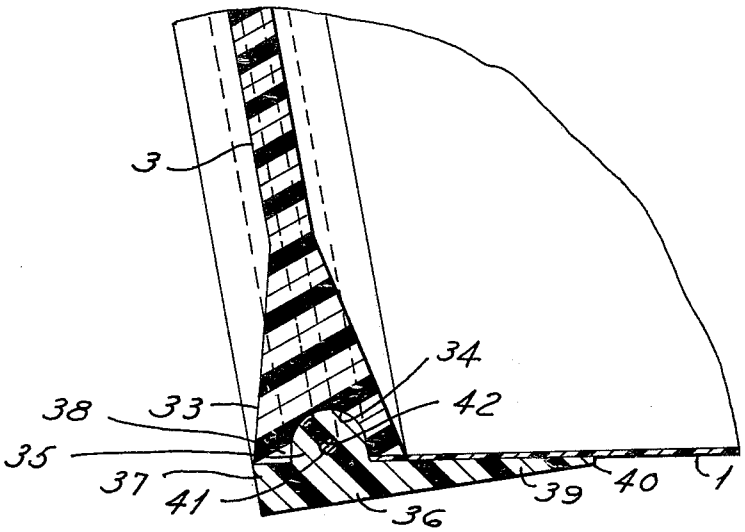
FIG. 5 is a cross section taken on the Line 5—5 of FIG. 3 and FIG. 4.
Figure 3:
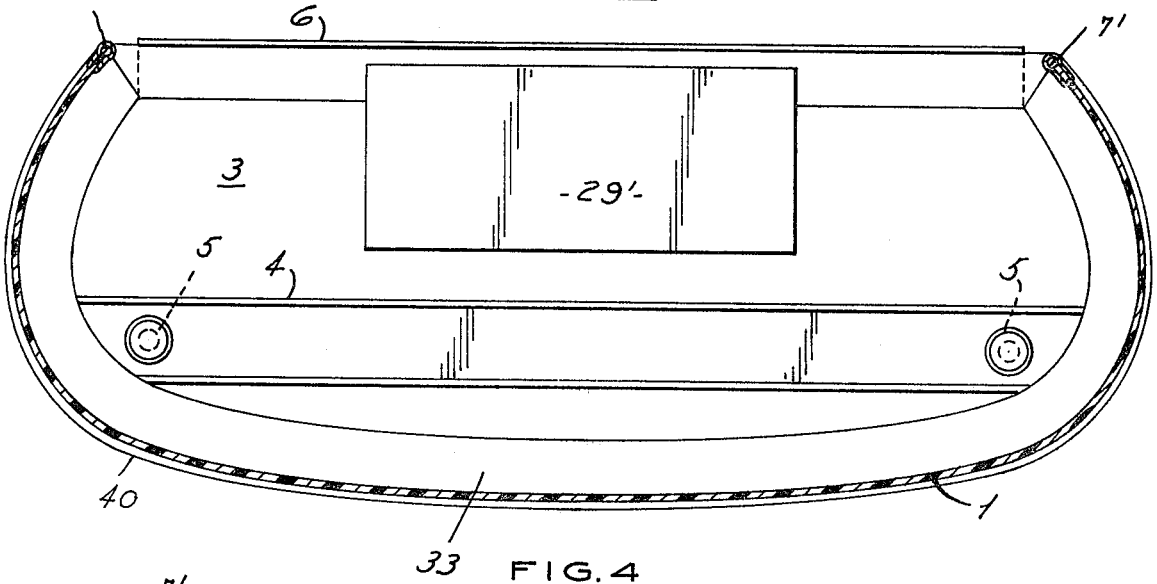
FIG. 3 is an elevational view of the transom looking inside the boat toward the rear.

In the following description of the manner of securing the skin 1 to the end members 2 and 3, it will be understood that the same applies both to the stern and bow portions. The description will be directed toward the stern or transom portion 3. In FIG. 5 the transom 3 has a peripheral enlargement 33 extending around the bottom and on two sides thereof, which enlargement 33 is grooved at 34 to receive a laterally extending mating rib or male portion 35 of a flexible member 36 which can be formed as an elastomeric extrusion. The member 36 has an outwardly extending portion 37 terminating coextensive with the outer edge 38 of the enlargement 33. The member 36 has an inwardly extending portion 39 which tapers to a substantially feather edge 40. Skin member 1 is bonded to the portion 39 by any suitable means such as thermal bonding or cementing (not shown). Stress applying means such as cable member 41 which can be stainless steel, bronze, or any suitable non-corrosive material is disposed in an aperture 42 formed in the male portion 35 of member 36 and coextensive in length therewith. The cable 41 may be either molded in the member 36 at the time of the formation of the flexible member or the aperture 42 can be molded therein and the cable 41 passed through the aperture. Cable 41 is of such a length as to extend completely about the periphery of each respective bow or stern member. Extending across the upper portion of the member 3 is a groove 43 adapted to receive the cable 41, said groove being enlarged at 44 to receive any suitable means for joining the ends of cable 41. As shown a sleeve 45 is crimped over the cable and ball members 46 are crimped on the terminal ends of the cable 41 and act as safety means to prevent the cable from escaping from the crimped sleeve 45.

In the assembly of the skin 1 to the bow 2 and transom 3, a suitable sealant or adhesive is first placed into the bottom and sides of groove 34 and the male portion 35 of the elastomer force fitted thereinto. The cable 41 is then tensioned, and sleeve 45 crimped in place. Crimped balls 46 are thereafter applied as a safety precaution. The skin member 1 is thereby firmly secured to the end members in water-tight condition.

In the disclosed embodiment of my collapsible dinghy, the floatation devices or modules 31, 31*a*, 31', and 31*a'* bear against the flexible skin 1 at the chine and serve in part to reinforce the same against the inward collapse. However, the shape of the hull is primarily determined by the configuration of the generally confronting bow and stern plates 2 and 3 and the stretching of the skin 1 therebetween. The distension means or distensible members 13 and 13' are longitudinally resilient by virtue of the coil spring 20 but are laterally essentially rigid.

Figure 8:
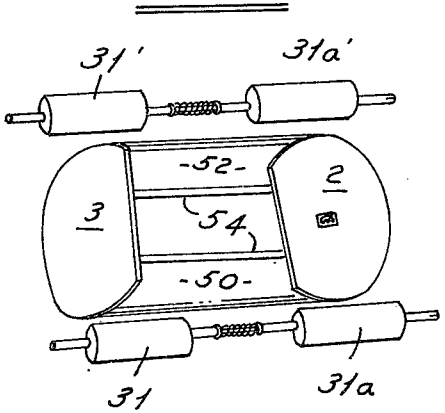
FIG. 8 shows the dinghy collapsed with parts disassembled preparatory to either erection or folding-up for storage.

In FIG. 8 I have shown the dinghy with the flexible skin folded inwardly at 50 and 52 with the gunwales shown at 54. The bow and stern members 2 and 3 may be folded over the skin 1 toward each other. By disengaging sections 14 and 15 of each of the longitudinal distending beams, these elements may be laid transversely within the dinghy as it is folded up thereby providing a single, compact package.

It will be apparent from the foregoing description that the pivotal connection of the distending members at the stern 3 may instead be at the bow 2 and the track means 9 may be at the stern rather than at the bow.

The term elastomer or elastomeric extrusion as used throughout this specification and claims is to be accepted in the generic sense as including all types of materials which are capable of extrusion.

What is claimed is:

1. A boat structure adapted to be repeatedly collapsed and erected comprising:

substantially rigid free floating bow and stern members, a flexible skin extending between and water-tightly joined to said members and forming a hull portion therebetween having upper free marginal gunwale edges, elongated telescopically compressible distensible means extending between and separably engaging each of said bow and stern members near the outer peripheries thereof to urge them apart and stress the skin member therebetween to form the hull configuration, and means on one of said members extending transversely thereof for slidably cooperating with the distensible means to assist in telescopically compressing said distensible means.

2. The invention defined by claim 1 wherein said means on one of said members comprises a track means for engaging one adjacent end of the distensible means when the same is disposed diagonally between the bow and stern members and for guiding said end of the distensible means toward the periphery of such member when such end of the distensible means is forced laterally toward a position of fore and aft alignment in the boat.

3. A boat structure adapted to be repeatedly collapsed and erected comprising:

substantially rigid bow and stern members, a flexible skin extending between and watertightly joined to said members and adapted to form a hull portion therebetween having upper free marginal gunwale edges, flexible means extending between the bow and stern members for limiting the distension of the skin as such members are urged apart, means for distending the boat fore and aft and stretching taut the skin comprising a plurality of elongated longitudinally compressible members, having an initial uncompressed length exceeding the longitudinal distance between the bow and stern members, but shorter than a diagonal distance therebetween, means for separably pivotally connecting one end of said distension members to one of the bow or stern members adjacent the skin, track means for slidably connecting the opposite ends of the distension members to the opposite bow or stern member when the distension members are disposed diagonally between the bow and stern members and for guiding such end transversely across such bow or stern member toward the skin and compressing the distension members longitudinally to distend the skin, and means for releasibly locking the distension members against sliding movement on the track means adjacent the skin following distension of the skin.

4. The invention defined by claim 3 wherein the flexible means for limiting distension of the skin comprises relatively non-stretchable cable means connected to the gunwale of the skin.

5. The invention defined by claim 3 wherein floatation means is secured to said distension members.

6. The invention defined by claim 5 wherein said floatation means is shaped to conform to the distended skin of the hull and bears thereagainst.

7. The invention defined by claim 3 wherein said distension members have longitudinally extending portions shaped to define the transverse configuration of the hull and adapted to bear against the flexible watertight skin to reinforce the same against inward collapse.

8. In a collapsible boat:

substantially rigid bow and stern members each having an outwardly opening peripheral edge groove, a flexible skin extending between the bow and stern members to form a hull therebetween, an elastomeric member bonded to the skin adjacent the bow and stern members and having a laterally projecting rib portion for nesting in said peripheral edge groove, means for watertightly sealing the rib portion in said groove, and elongated stress applying means extending longitudinally of the elastomeric member and overlying the rib portion opposite the groove and extending peripherally around the marginal edge of the bow and stern members for locking the rib portion in the groove.

9. A collapsible boat comprising essentially three portions:

a hull formed of substantially rigid bow and stern members with a flexible watertight skin extending therebetween and watertightly connected thereto, a pair of elongated longitudinally compressible laterally rigid distensible members having an uncompressed length exceeding the longitudinal distance between the bow and stern members but less than the diagonal distance therebetween, said distensible members being removably pivotally connectible at one end to one of the bow or stern members and means on said distensible members slidably abutting at the opposite end the other bow or stern member for lateral forceable sliding movement from a diagonal position to a position extending longitudinally of the boat for distending the bow and stern members and stressing the skin therebetween, and means for releasably locking the distensible members against sliding movement adjacent the skin following stressing of the skin.

10. A structure adapted to be repeatedly collapsed and erected comprising:

substantially free floating end members having face portions thereof arranged in generally confronting relation, a flexible skin member joined to said end members by means forming a watertight joint.

at least two longitudinally distensible skin stressing members extending substantially parallel to said skin member and disposed between and separably engaging the confronting face of each of said end members near the outer periphery thereof for urging them apart and rendering the skin taut, said distensible skin stressing members being the sole means between the end members for urging them apart, compressible means provided on each of said distensible skin stressing members for distending the same and maintaining the skin taut, and means on one of said end members extending transversely thereof and cooperating with said distensible members to assist in compressing said compressible means.

11. A device as set forth in claim 10 wherein separable engaging means is provided between said distensible means and one of said end members including a universal type joint.

12. A device as in claim 10 wherein the means on one of said end members to assist in compressing said compressible means rigidly protrudes from one face of said end member, and means on said distensible member adapted to movably engage said protruding means for facilitating shifting of the distensible member transversely of the end member.

13. A device as in claim 10 wherein at said watertight joint the skin member is fixedly received in a groove in each end member, and means for urging the skin member into each such groove.

14. A device as in claim 10 wherein said rigid free floating end members are resistingly rotatable about a longitudinal axis extending between said generally confronting end members, when the skin is taut.

15. A device as set forth in claim 10 wherein the ends of each distensible member are disposed on the end member substantially at the point where inward collapsing forces are balanced.

16. A device as set forth in claim 10 wherein the said watertight joint comprises elongated means extending along the periphery of the end member and overlying the skin member in the groove and tensioned to maintain the skin member in the groove.

17. In a collapsible boat:

substantially rigid bow and stern members each having an outwardly opening peripheral edge groove, a flexible skin extending between the bow and stern members to form a hull therebetween and disposed in said edge grooves, and an elongated stress applying means extending longitudinally of each groove and overlying the skin opposite the groove and extending peripherally around the marginal edge of the bow and stern members applying hoop tensions thereto for locking the skin in the grooves.

18. A device as in claim 17 wherein said skin member includes an elastomeric marginal edge portion disposed in the groove and said stress applying means overlie said elastomeric marginal edge.

19. A boat structure adapted to be repeatedly collapsed and erected comprising:

substantially rigid bow and stern members, a flexible skin extending between and watertightly joined to said members and adapted to form a hull portion therebetween having upper free marginal gunwale edges, means for distending the boat fore and aft and stretching taut the skin comprising a plurality of elongated longitudinally compressible members, having an initial uncompressed length exceeding the longitudinal distance between the bow and stern members, but shorter than a diagonal distance therebetween, means for separably pivotally connecting one end of said distension members to one of the bow or stern member adjacent the skin, track means for slidably connecting the opposite ends of the distension members to the opposite bow or stern member when the distension members are disposed diagonally between the bow and stern members and for guiding such end transversely across such bow or stern member toward the skin and compressing the distension members longitudinally to distend the skin, and means for releasibly locking the distension members against sliding movement on the track means adjacent the skin following distension of the skin.

20. The invention defined by claim 19 wherein floatation means is secured to said distension members.

* * * * *